US007610659B2

(12) United States Patent
Current

(10) Patent No.: US 7,610,659 B2
(45) Date of Patent: Nov. 3, 2009

(54) APPARATUS AND METHOD FOR MAKING A POLYMER FILL

(75) Inventor: Tom C. Current, Amarillo, TX (US)

(73) Assignee: Arden Companies, Southfield, MI (US)

( * ) Notice: Subject to any disclaimer, the term of this patent is extended or adjusted under 35 U.S.C. 154(b) by 762 days.

(21) Appl. No.: 11/244,713

(22) Filed: Oct. 6, 2005

(65) Prior Publication Data

US 2007/0079480 A1 Apr. 12, 2007

(51) Int. Cl.
*D01G 15/02* (2006.01)

(52) U.S. Cl. ..... 19/98; 19/296; 19/161.1

(58) Field of Classification Search ..... 19/98, 19/161.1, 296

See application file for complete search history.

(56) References Cited

U.S. PATENT DOCUMENTS

| | | | | |
|---|---|---|---|---|
| 2,998,623 | A | 9/1961 | Lawson et al. | |
| 3,577,844 | A | 5/1971 | Towery | |
| 3,664,905 | A | 5/1972 | Schuster | |
| 3,673,699 | A | 7/1972 | Buffington | |
| 3,931,376 | A | 1/1976 | Hartmann | |
| 4,037,006 | A | 7/1977 | Roberts et al. | |
| 4,096,793 | A | 6/1978 | Wachter et al. | |
| 4,146,417 | A * | 3/1979 | Drelich et al. | 156/62.2 |
| 4,147,582 | A | 4/1979 | Brollo | |
| 4,238,178 | A | 12/1980 | Bailey | |
| 4,534,086 | A * | 8/1985 | Fehrer | 19/99 |
| 4,573,991 | A | 3/1986 | Pieniak et al. | |
| 4,809,404 | A * | 3/1989 | Lasenga | 19/106 R |
| 4,912,857 | A | 4/1990 | Parent et al. | |
| 5,169,571 | A | 12/1992 | Buckley | |
| 5,254,301 | A | 10/1993 | Sessions et al. | |
| 5,865,300 | A | 2/1999 | Newsome | |
| 6,141,833 | A * | 11/2000 | Sørensen | 19/308 |
| 6,375,773 | B1 * | 4/2002 | Andersen | 156/148 |
| 2004/0242105 | A1 * | 12/2004 | McGuire | 442/327 |

FOREIGN PATENT DOCUMENTS

| | | |
|---|---|---|
| JP | 01201567 | 8/1989 |
| WO | WO97/36034 | 10/1997 |

* cited by examiner

*Primary Examiner*—Shaun R Hurley
(74) *Attorney, Agent, or Firm*—Honigman Miller Schwartz and Cohn LLP

(57) ABSTRACT

A process for manufacturing a polymer fill, the method comprising the steps of blending polymer fibers to form a polymer fill, depositing the polymer fill onto a surface, orientating the polymer fibers in a desired orientation, heating the polymer fill, compressing the polymer fill and cooling the polymer fill. The surface carries the polymer fill from the blending step through the heating step, and wherein the polymer fill enters the compression step independent of the surface.

27 Claims, 4 Drawing Sheets

APPARATUS AND METHOD FOR MAKING A POLYMER FILL

TECHNICAL FIELD

The present invention generally relates to the production of polymer products and particularly, to a method of manufacturing a low melt compressed polymer fill.

BACKGROUND OF THE INVENTION

There are essentially two methods for producing a nonwoven fiber batt, a dry method and a wet method. With the wet method, there is, just as in the production of paper, an emulsion produced which consists of a liquor and fibers which are disposed crossways from which the emulsion and liquor is removed by a force of gravity and by means of suction pumps with subsequent drying units. The wet web producing method features high production speeds and a great uniformity of the web, which consists of crossways lying fibers, but on the other hand it necessitates very power consuming subsequent drying processes and apparatus.

Completely dry processes for forming nonwoven fibrous batts are known and are described in the prior art. The dry method consists of applying a powdery or granular bonding agent or melting film or bonding agents to the web. These bonding agents are then melted with a heating unit and subsequently re-hardened so that the web fibers stick together.

Nonwoven fabrics are now used for a variety of purposes in a number of industries. These fabrics have been made traditionally by methods such as carding, garnetting, air-laying and the like. Nonwoven webs have been made to have most of the fibers therein oriented in the machine direction; other nonwoven webs have been made to have some cross orientation; and still other webs have been produced having a randomized fiber distribution.

SUMMARY OF THE INVENTION

The inventors of the invention have recognized these and other problems associated with the nonwoven fabrics. To this end, the inventors have invented a process for manufacturing a polymer fill, the method comprising the steps of blending polymer fibers to form a polymer fill, depositing the polymer fill onto a surface, orientating the polymer fibers in a desired orientation, heating the polymer fill, compressing the polymer fill and cooling the polymer fill. The surface carries the polymer fill from the blending step through the heating step, and wherein the polymer fill enters the compression step independent of the surface.

DETAILED DESCRIPTION

Figure 1:
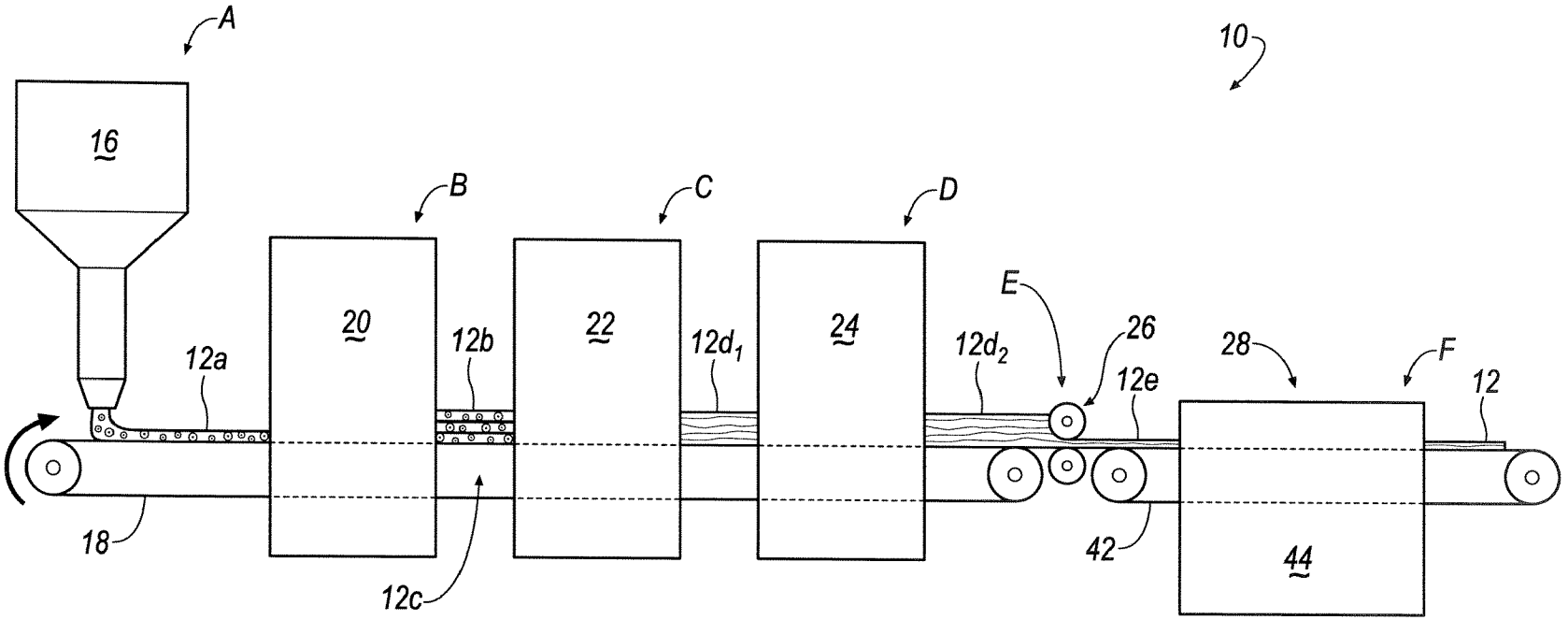
FIG. 1 is a perspective view of an assembly for manufacturing polymer fill according to an embodiment of the invention.
Figure 2:
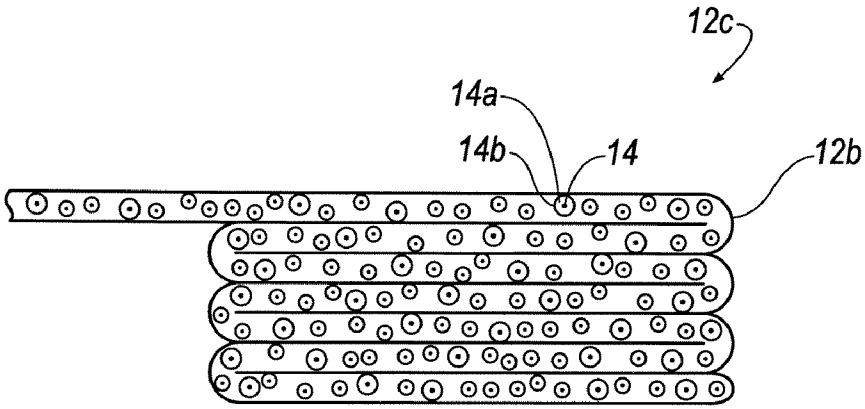
FIG. 2 is a side view of a horizontally-oriented batt according to an embodiment of the invention.

Referring to FIG. 1, an assembly 10 for manufacturing a nonwoven fabric 12, such as a polymer fill, is generally shown. The polymer fill 12 is typically made of a polymer fill, as known in the field of manufacturing polymer products, and may include a blend of polymer fibers, such as polymer staple fibers 14 of different denier. Referring to FIG. 2, each polymer staple fiber 14 may be comprised of a polymer inner core 14*a* and a low melting point co-polymer outer sheath 14*b*.

Polymers suitable for the invention include polyolefins, polymers, polyamides, polycarbonates and copolymers and blends thereof. Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and a tactic polypropylene; polybutylene, e.g., poly(1-butene) and poly(2-butene); polypentene, e.g., poly(1-pentene) and poly (2-pentene); poly(3-methyl-1-pentene); poly(4-methyl-1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polymers include polyethylene terephthalate, poly-butylene terephthalate, polytetramethylene terephthalate, polycyclohexylene-1,4-dimethylene terephthalate, and isophthalate copolymers thereof, as well as blends thereof.

It should be noted that the above listing of suitable thermoplastic polymers is not exhaustive and other polymers known to one of ordinary skill in the art may be employed, so long as the particular combination of polymers selected to be the components of the multicomponent fiber are capable of being co-spun in a fiber extrusion process, which will depend on such factors as, for example, the relative viscosities of the thermoplastic melt. In addition, it should be noted that the polymers may desirably contain other additives such as, reaction products including, processing aids, treatment compositions to impart desired properties to the multicomponent fibers, residual amounts of solvents, pigments or colorants and the like.

The assembly 10 for manufacturing a polymer fill 12 may comprise a blender 16, a surface 18, a first fiber-orienting machine, such as a carding machine 20, a second fiber orienting machine, such as a second carding machine 22, an oven 24, a compression system 26 and a cooling system 28. While a garnett machine is not shown, it can be appreciated that the invention may be practiced with a garnett machine in combination with carding machines 20, 22, or with a garnett machine in replace of either or both carding machines 20, 22. It should be noted that carding machines and garnett machines are generally known in the art.

Initially, polymer staple fibers 14 undergo a blending process A. The blending process A may be carried out by placing polymer staple fibers 14 of different denier in blender 16 and mixing the polymer staple fibers 14 together to form the polymer fill 12*a*. Once the blending process A has been completed, the polymer fill 12*a* may be deposited onto surface 18, such as, for example, a conveyor belt.

The polymer fill 12*a* may be subjected to a first fiber-orientating step B. The first fiber-orientating step B may include a means for orientating the polymer staple fibers 14 into a desired orientation, such as, for instance, by feeding the polymer fill 12*a* through first carding machine 20. First carding machine 20 combs through the polymer fill 12*a* and aligns the polymer staple fibers 14 into a first desired orientation. As illustrated, first carding machine 20 orients polymer staple fibers 14 to form a substantially horizontally-oriented batt 12*b*. First carding machine 20 may further include a lapping apparatus (not shown) which releases the horizontally-oriented batt 12*b* onto conveyor belt 18 in a lapping motion to form a multilayered batt 12*c*, as illustrated in FIG. 2. As a result, first carding machine 20 deposits successive layers of polymer fill on top of each other. The number of successive layers of polymer fill depends upon the desired specification of the polymer fill 12. For instance, if a thick polymer fill 12 is desired, several successive layers of polymer fill may be deposited on top of each other. Conversely, if a thin polymer fill 12 is desired, few successive layers of polymer fill may be deposited on top of each other. However, it can be appreciated that the horizontally-oriented batt 12*b* may be released onto conveyor belt 18 in any suitable manner, so long as the polymer staple fibers 14 remain in a generally horizontal orientation.

Figure 3:
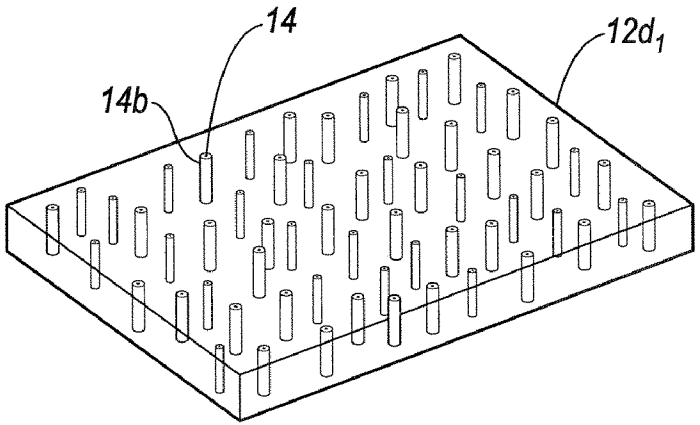
FIG. 3 is a top view of a vertically-oriented batt according to an embodiment of the invention.

Once polymer staple fibers 14 have been horizontally-oriented, the multilayered batt 12*c* may be subjected to a second fiber-orientating step C. The second fiber-orientating step C may include passing the multilayered batt 12*c* through a second carding machine 22. The second carding machine 22 may be, for example, an air lay carding machine which redirects the orientation of the polymer staple fibers 14 of multilayered batt 12*c* into a second desired orientation. For example, as illustrated, second carding machine 22 orients polymer staple fibers 14 to form a substantially vertically-oriented batt $\mathbf{12}d_1$ , as illustrated in FIG. 3. During operation, the air lay machine 22 typically pulls a large volume of air through the multilayered batt 12*c*, thereby causing the polymer staple fibers 14 to re-orientate. The degree of reorientation may be dependent upon the volume of air pulled within the air lay machine 22. It can be appreciated that carding machines and air lay machines 22, are known in the art of manufacturing polymer fill 12.

The vertically-orientated batt $\mathbf{12}d_1$ may be subjected to a heat-fusing step D to fuse at least a portion of the polymer staple fibers 14 to adjacent polymer staple fibers 14. The heat-fusing step D may be carried out by passing the vertically-oriented batt $\mathbf{12}d_1$ through a means for heating the vertically-oriented batt $\mathbf{12}d_1$, such as, for example, an oven 24. In one type of oven 24, forced air may be conducted through the vertically-oriented batt $\mathbf{12}d_1$, causing the low melting point co-polymer outer sheath 14*b* to change from a solid state to a liquid state. Accordingly, heat is conducted to vertically-orientated batt $\mathbf{12}d_1$ for an amount of time sufficient to cause low melting point co-polymer outer sheath 14*b* to at least partially melt, or fuse, so that upon cooling, the polymer staple fibers 14 fuse to adjacent fibers to form a heated vertically-oriented batt $\mathbf{12}d_2$. It can be appreciated that the temperature of the forced air passing through oven 24 may vary depending upon the fusing temperature of the low melting point co-polymer outer sheath 14*b*. Thus, oven 24 may be set to a predetermined temperature that is at least equal to the fusing point of the low melting point co-polymer outer sheaths 14*b*, or may be set to a temperature above the fusing point of low melting point co-polymer outer sheath 14*b*. It can be further appreciated that using an oven to heat-fuse polymer staple fibers 14 together is known in the art of manufacturing polymer fill 12.

The heated vertically-oriented batt $\mathbf{12}d_2$ may be carried from oven 24 to a compression step E via conveyor belt 18. The compression step E may be carried out by passing the heated vertically-oriented batt $\mathbf{12}d_2$ through a means for compressing, or compression system 26. Compression system 26 comprises of a set of steel rollers 32 stacked vertically, with a top steel roller 34 stacked above a bottom steel roller 36.

The top and bottom steel rollers 34, 36 are separated by a gap 38. Bottom roller 36 is mounted rigidly at approximately the same elevation as conveyor belt 18, while top roller 34 is mounted independently of bottom roller 36 by a set of jack screws 48. The jack screws 48 are driven by an electric motor (not shown). Accordingly, top roller 34 may be adjusted vertically up and down, to increase or decrease gap 38, by jack screws 48.

It should be noted that the calculation of gap 38 may be dependent upon several factors, including, amongst others, the rise times of reaction products in the vertically-oriented batt $\mathbf{12}d_2$, the percent rise of the reaction products per unit of time, the desired characteristics of polymer fill 12, the speed at which the vertically-oriented batt $\mathbf{12}d_2$ enters the compression system 26, and the like.

Figure 4:
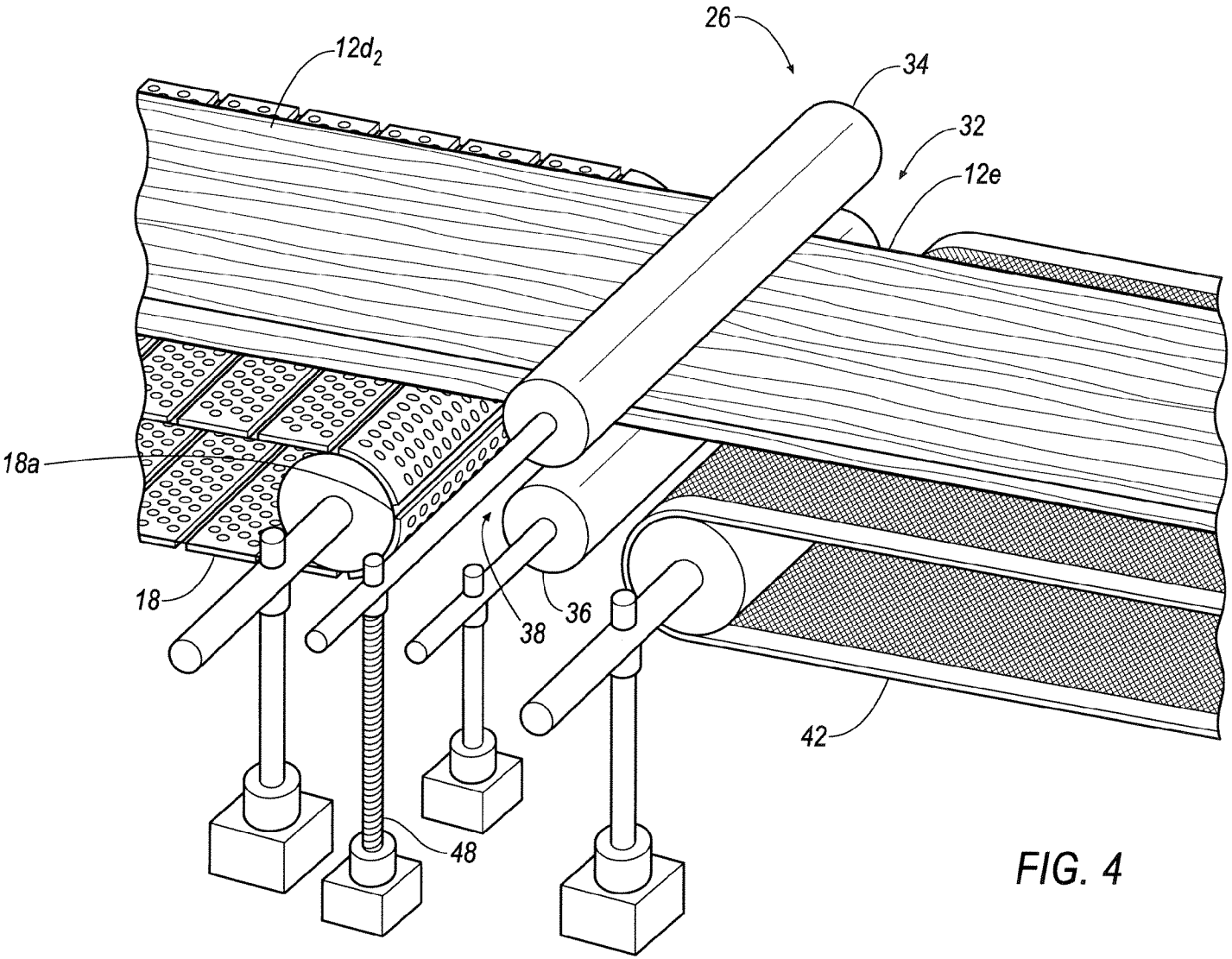
FIG. 4 is an expanded view of a compression system according to an embodiment of the invention.

As illustrated in FIGS. 1 and 4, conveyor belt 18 carries the vertically-oriented batt $\mathbf{12}d_2$ towards top and bottom rollers 34, 36. However, conveyor belt 18 ends prior to reaching the compression system 26. Accordingly, a gap 38 exists between an end 18*a* of conveyor belt 18 and the start of the compression system 26. Therefore, when vertically-oriented batt $\mathbf{12}d_2$ enters the compression step E, top and bottom rollers 34, 36 may be able to provide compression forces against both top and bottom surfaces of vertically-oriented batt $\mathbf{12}d_2$. The speed of the top and bottom rollers 34, 36 may be dependent upon several factors, including, amongst others, the rise times of reaction products in the vertically-oriented batt $\mathbf{12}d_2$ the percent rise of the reaction products in the vertically-oriented batt $\mathbf{12}d_2$ per unit of time, the desired final characteristics of the polymer fill 12, the speed of the vertically-oriented batt $\mathbf{12}d_2$ coming off of conveyor belt 18, and the like. It can be appreciated that the invention is not limited to a single set of rollers 32 and may be practiced with any number of sets of rollers 32 so long as the vertically-oriented batt $\mathbf{12}d_2$ may be compressed to the desired thickness.

Immediately following the compression step E, the compressed vertically-oriented batt 12*e* is deposited onto a wire mesh conveyor belt 42, such as a Kevlar conveyor belt, and carried to a cooling step F. The cooling step F may be completed by passing the compressed vertically-oriented batt 12*e* through a means for cooling, or cooling system 28, which may include a duct, an inner chamber 44, or the like, and an air moving fan 46 connected to inner chamber 44. As illustrated, fans 46 are located on opposing sides of conveyor belt 42 and at proximately the same height. However, it can be appreciated that the invention may be practiced with fans 46 being placed at any location, including fans 46 placed on the same side of conveyor belt 42.

Inner chamber 44 may be located underneath, and extend across the width, of wire mesh conveyor belt 42 and may include a top surface which is open to the ambient air. During operation, fans 46 create a suction force within inner chamber 44, and as a result, cause the ambient air to be suctioned through compressed vertically-oriented batt 12*e* and into inner chamber 44. As a result, the ambient air cools the compressed vertically-oriented batt 12*e* as it is suctioned into inner chamber 44. The wire mesh conveyor belt 42 allows for ambient air to properly flow through compressed vertically-oriented batt 12*e* and into inner chamber 44 when fans 46 are operating. As with the compression step E, the speed of the mesh conveyor belt 42 may be dependent upon several factors, including, amongst others, the setting times of reaction products in the compressed vertically-oriented batt 12*e*, the percent rise of the compressed vertically-oriented batt 12*e* per unit of time, the desired final characteristics of the polymer fill 12, and the like. It should be noted that the cooling system 28 is not limited by the number of inner chambers 44 and fans 46 illustrated, and may be practiced with any number of inner chambers 44 and fans 46, so long as the compressed vertically-oriented batt 12*e* is properly cooled. Further, it can be appreciated that one fan 46 may be connected to several inner chambers, and vice versa.

Figure 5:
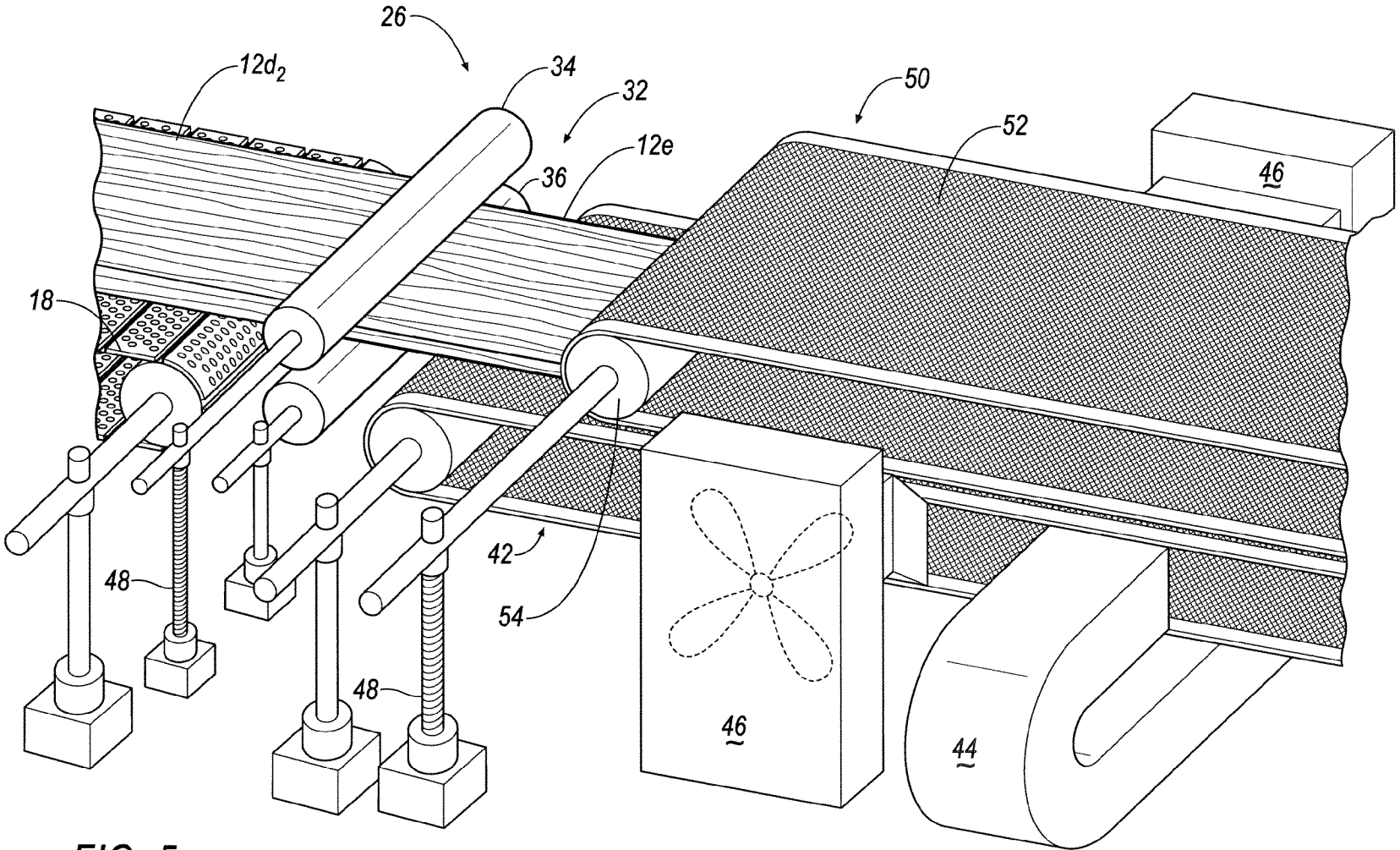
FIG. 5 is an expanded view of an alternate cooling system according to an embodiment of the invention.

In an alternate embodiment of the invention, cooling system 28 may include an apron 50 placed over the wire mesh conveyor belt 42, as illustrated in FIG. 5. The apron 50 may be supported by jack screws 48. The jack screws 48 may raise or lower apron 50, depending upon the distance desired between wire mesh conveyor belt 42 and apron 50. Apron 50 may include a second means for compressing, such as, for example, a second wire mesh conveyor belt 52, similar to wire mesh conveyor belt 42, and a steel roller 54. When the compressed vertically-oriented batt 12*e* enters the cooling system 28, steel roller 54 provides additional compression forces on the compressed vertically-oriented batt 12*e*. Then, as compressed vertically-oriented batt 12*e* is carried by wire mesh conveyor belt 42 through cooling system 28, second wire mesh conveyor belt 52 may provide constant, uniform compression forces on compressed vertically-oriented batt 12*e*.

Upon completion of the cooling step F, the polymer fill 12 having a predetermined thickness is formed. It can be appreciated that the polymer fill 12 may be subject to secondary manufacturing processes, such as, for example, a cutting process to cut the polymer fill 12 to any desirable length or shape, or a wrapping process to cover the polymer fill 12 with a decorative cover. Alternatively, the polymer fill 12 may be rolled up and packaged straight from the mesh conveyor belt.

The embodiments disclosed herein have been discussed for the purpose of familiarizing the reader with novel aspects of the invention. Although preferred embodiments of the invention have been shown and described, many changes, modifications and substitutions may be made by one having ordinary skill in the art without necessarily departing from the spirit and scope of the invention as described in the following claims.

The invention claimed is:

1. A process for manufacturing a non-woven product, comprising the steps of:

depositing a layer of polymer fill including fibers onto at least one movable surface, wherein the movable surface transports the deposited layer of polymer fill including the fibers to one or more stations for orientating the fibers in a non-random orientation, heating the layer of polymer fill including the orientated fibers, compressing the layer of polymer fill including the orientated, heated fibers, and cooling the layer of polymer fill including the orientated, heated, compressed fibers; and forming the transported layer of polymer fill including the orientated, heated, compressed and cooled fibers into a non-woven fabric, wherein the orientating step includes aligning the fibers in a first non-random orientation, wherein the first non-random orientation includes a horizontal orientation, and aligning the fibers in a second non-random orientation, wherein the second non-random orientation includes a vertical orientation.

2. The process of claim 1, wherein the compressing step includes utilizing two rollers including a top roller and a bottom roller, wherein the top roller and the bottom roller are arranged to define a gap therebetween, and passing the layer of polymer fill including the orientated, heated fibers through the gap.

3. The process of claim 2 wherein the compressing step further comprises the step of independently mounting the top roller relative the bottom roller, and permitting an adjustment of the gap between the top roller and the bottom roller by adjusting a mounting orientation of the top roller.

4. The process of claim 1, wherein the heating step includes utilizing an oven for adjusting a temperature setting of the oven to be at least equal to a fusing temperature of the layer of polymer fill including the orientated fibers.

5. The process of claim 1, wherein the cooling step includes utilizing an inner chamber having at least one fan, wherein the inner chamber is open to ambient air and the at least one fan is utilized for moving ambient air through the layer of polymer fill including the orientated, heated, compressed fibers for cooling the fibers.

6. The process of claim 1, wherein the cooling step includes further compressing the orientated, heated, compressed fibers for providing a constant compression force on the layer of polymer fill including the fibers as the orientated, heated, compressed fibers are being cooled.

7. The process of claim 1, further comprising the step of:

providing the fibers to the compressing step independent of the movable surface.

8. The process of claim 1, wherein the orientating step includes:

lapping the layer of polymer fill into a plurality of stacked, successive polymer fill layers.

9. An assembly for manufacturing a non-woven product, comprising:

a conveyor that provides means for carrying a layer of polymer fill including a plurality of fibers through one or more stations including a first carding machine that provides means for aligning the plurality of fibers in a first, non-random, horizontal orientation, a second carding machine that provides means for aligning the plurality of fibers in a second, non-random, vertical orientation, and an oven that provides means for heating the layer of polymer fill including the plurality of orientated fibers;

a pair of rollers that provides means for compressing the layer of polymer fill including the plurality of orientated, heated fibers; and a cooling system that provides means for cooling the layer of polymer fill including the plurality of orientated, heated, compressed fibers.

10. The assembly according to claim 9 further comprising a blending station, wherein the blending station provides means for blending and subsequently depositing the layer of polymer fill including the plurality of fibers onto the conveyor prior to aligning the plurality of fibers in the first, non-random horizontal orientation by the first carding machine.

11. The assembly according to claim 9, wherein the cooling system further includes a lower conveyor, and an upper conveyor, wherein the lower conveyor and the upper conveyor are arranged relative one another at a distance to define a gap therebetween, wherein the upper conveyor and the lower conveyor provide means for further compressing the layer of polymer fill including the plurality of orientated, heated, compressed fibers with a constant compression force.

12. The assembly according to claim 11, further comprising:

an adjuster assembly coupled to the upper conveyor, wherein the adjuster assembly provides means for adjusting the distance of the upper conveyor relative the lower conveyor for controlling the distance between the upper conveyor and the lower conveyor.

13. The assembly according to claim 9, wherein the cooling system includes:

an inner chamber, and at least one fan, wherein the inner chamber is open to ambient air, wherein the at least one fan provides means for moving ambient air though the layer of polymer fill including the plurality of orientated, heated, compressed fibers.

14. The assembly according to claim 9, wherein the first carding machine further provides:

means for lapping the layer of polymer fill into a plurality of stacked, successive polymer fill layers.

15. An assembly for manufacturing a non-woven product, comprising:

a conveyor including a first, upstream end and a second, downstream end, wherein the conveyor interfaces with at least two carding machines, and an oven a pair of compression rollers including an input side and an output side, wherein the input side is located proximate the second, downstream end of the conveyor; and a cooling system located proximate the output side of the pair of rollers.

16. The assembly according to claim 15, wherein the conveyor provides:

means for carrying a layer of polymer fill including a plurality of fibers through a first carding machine of the at least one carding machine, a second carding machine of the at least one carding machine, and the oven, wherein the oven provides means for heating the layer of polymer fill including the plurality of orientated fibers.

17. The assembly according to claim 16, wherein the first carding machine provides:

means for aligning the plurality of fibers in a first, non-random, horizontal orientation, wherein the second carding machine provides means for aligning the plurality of fibers in a second, non-random, vertical orientation.

18. The assembly according to claim 17, wherein the first carding machine further provides:

means for lapping the layer of polymer fill into a plurality of stacked, successive polymer fill layers.

19. The assembly according to claim 17, further comprising:

a blending station located proximate the first, upstream end of the conveyor.

20. The assembly according to claim 19, wherein the blending station provides:

means for blending and subsequently depositing the layer of polymer fill including the plurality of fibers onto the conveyor prior to aligning the plurality of fibers in the first, non-random, horizontal orientation by the first carding machine.

21. The assembly according to claim 16, wherein the cooling system includes:

an inner chamber, and at least one fan.

22. The assembly according to claim 21, wherein the at least one fan provides:

means for moving ambient air through the layer of polymer fill including the plurality of orientated, heated, compressed fibers.

23. The assembly according to claim 16, wherein the pair of compression rollers provide:

means for compressing the layer of polymer fill including the plurality of orientated, heated fibers.

24. The assembly according to claim 16, wherein the cooling system provides:

means for cooling the layer of polymer fill including the plurality of orientated, heated, compressed fibers.

25. The assembly according to claim 16, wherein the cooling system includes:

a lower conveyor, and an upper conveyor, wherein the lower conveyor and the upper conveyor define a distance therebetween.

26. The assembly according to claim 25, further comprising:

an adjuster assembly coupled to the upper conveyor.

27. The assembly according to claim 26, wherein the adjuster assembly provides:

means for adjusting the distance between the upper conveyor relative the lower conveyor for controlling the distance between the upper conveyor and the lower conveyor.

* * * * *